US011512928B2

(12) United States Patent
Larsson et al.

(10) Patent No.: US 11,512,928 B2
(45) Date of Patent: Nov. 29, 2022

(54) ADJUSTABLE REFLEX SIGHT

(71) Applicant: Aimpoint AB, Malmö (SE)

(72) Inventors: Niklas Larsson, Åkarp (SE); Olof Martinsson, Malmö (SE)

(73) Assignee: Aimpoint AB, Malmö (SE)

( * ) Notice: Subject to any disclaimer, the term of this patent is extended or adjusted under 35 U.S.C. 154(b) by 0 days.

(21) Appl. No.: 17/275,454

(22) PCT Filed: Sep. 12, 2019

(86) PCT No.: PCT/SE2019/050865
§ 371 (c)(1),
(2) Date: Mar. 11, 2021

(87) PCT Pub. No.: WO2020/055319
PCT Pub. Date: Mar. 19, 2020

(65) Prior Publication Data

US 2022/0099409 A1 Mar. 31, 2022

(30) Foreign Application Priority Data

Sep. 12, 2018 (SE) ..... 1851079-2

(51) Int. Cl.
*F41G 1/30* (2006.01)

(52) U.S. Cl.
CPC ..... *F41G 1/30* (2013.01)

(58) Field of Classification Search
CPC ..... F41G 1/30
(Continued)

(56) References Cited

U.S. PATENT DOCUMENTS 3,826,012 A 7/1974 Pachmayr
4,389,791 A * 6/1983 Ackerman ..... G01C 3/04 42/122

(Continued)

FOREIGN PATENT DOCUMENTS

DE 102006016834 A1 10/2007
EP 2314978 A2 4/2011

(Continued)

OTHER PUBLICATIONS

International Search Report dated Nov. 20, 2019 for corresponding PCT application PCT/SE2019/050865.

*Primary Examiner* — Samir Abdosh
(74) *Attorney, Agent, or Firm* — Renner, Otto, Boisselle & Sklar, LLP

(57) ABSTRACT

An adjustable reflex sight comprising an elongated sight housing comprising an outer tube and an inner tube pivotably mounted within the outer tube and holding an optical element for pivoting movement therewith, a sight adjustment mechanism mounted to the housing having an adjustable member movably mounted within the adjustment mechanism for altering a tilt angle of the inner tube in relation to the outer tube thereby adjusting the sight, a first adjustment device interlinked with a second adjustment device, wherein the first adjustment device is adjustably positionable about an axis of rotation for actuating said adjustable member, thereby altering the tilt angle of the inner tube, and the second adjustment device is adjustably positionable about the axis of rotation, such that the interlinked first adjustment device and the adjustable member are moved along the axis of rotation in response to rotation of the second adjustment device.

18 Claims, 5 Drawing Sheets

(58) Field of Classification Search
USPC ..... 42/122
See application file for complete search history.

(56) References Cited

U.S. PATENT DOCUMENTS

| | | | | |
|---|---|---|---|---|
| 4,945,646 | A * | 8/1990 | Ekstrand | G02B 23/105 356/252 |
| 6,519,890 | B1 * | 2/2003 | Otteman | G02B 23/16 42/122 |
| 6,691,447 | B1 * | 2/2004 | Otteman | F41G 1/38 42/129 |
| 6,807,742 | B2 | 10/2004 | Schick et al. | |
| 7,612,952 | B2 | 11/2009 | Schafer | |
| 7,624,526 | B2 * | 12/2009 | Paasikivi | F41G 1/38 42/111 |
| 8,001,714 | B2 * | 8/2011 | Davidson | G05B 15/02 42/122 |
| 8,166,697 | B1 * | 5/2012 | Sueskind | F41G 1/38 42/122 |
| 8,186,093 | B1 * | 5/2012 | Chung | F41G 1/35 42/119 |
| 8,296,991 | B1 * | 10/2012 | Chung | F41G 1/473 42/111 |
| 8,479,402 | B2 | 7/2013 | Schmitt | |
| 8,490,317 | B2 | 7/2013 | Adkins et al. | |
| 8,875,435 | B2 * | 11/2014 | Menges | F41G 1/38 42/122 |
| 9,046,913 | B2 | 6/2015 | Crispin | |
| 9,297,615 | B2 | 3/2016 | Meinert et al. | |
| 9,574,848 | B2 * | 2/2017 | Zimmermann | F41G 3/08 |
| 10,458,752 | B1 * | 10/2019 | Szalony | F41G 1/38 |
| 2004/0144013 | A1 * | 7/2004 | Leatherwood | F41G 1/545 42/126 |
| 2007/0068058 | A1 * | 3/2007 | Remo | F41G 1/32 42/122 |
| 2007/0137089 | A1 * | 6/2007 | William, III | F41G 1/38 42/122 |
| 2008/0007843 | A1 * | 1/2008 | Schafer | F41G 1/38 359/702 |
| 2011/0242650 | A1 * | 10/2011 | Windauer | G02B 23/14 74/553 |
| 2012/0192478 | A1 * | 8/2012 | Jahromi | G02B 23/02 42/122 |
| 2012/0266515 | A1 * | 10/2012 | Hamilton | F41G 1/38 42/119 |
| 2013/0167425 | A1 * | 7/2013 | Crispin | F41G 1/38 42/119 |
| 2014/0115942 | A1 * | 5/2014 | Plaster | F41G 1/38 42/126 |
| 2014/0319216 | A1 * | 10/2014 | Meinert | F41G 1/473 235/404 |
| 2014/0352487 | A1 * | 12/2014 | Crispin | G05G 1/10 74/553 |
| 2016/0061567 | A1 * | 3/2016 | Regan | G02B 23/10 42/119 |
| 2016/0069644 | A1 * | 3/2016 | Bell | F41G 1/38 89/204 |
| 2016/0102943 | A1 | 4/2016 | Teetzel et al. | |
| 2017/0160055 | A1 | 6/2017 | Meinert et al. | |
| 2017/0254620 | A1 * | 9/2017 | Dasukevich | F41G 1/38 |
| 2018/0224652 | A1 * | 8/2018 | Havens | G02B 7/04 |
| 2019/0049218 | A1 * | 2/2019 | Williams | F41G 1/30 |
| 2019/0219812 | A1 * | 7/2019 | Havens | G02B 23/04 |
| 2019/0324260 | A1 * | 10/2019 | Hamilton | G02B 23/10 |
| 2020/0232762 | A1 * | 7/2020 | Hamilton | F41A 9/62 |
| 2021/0310767 | A1 * | 10/2021 | Baker | F41G 1/545 |
| 2021/0348886 | A1 * | 11/2021 | Havens | F41G 3/165 |

FOREIGN PATENT DOCUMENTS

| | | | |
|---|---|---|---|
| EP | 2472214 | A2 | 7/2012 |
| JP | H0783599 | A * | 3/1995 |
| WO | 2004023059 | A1 | 3/2004 |

* cited by examiner

ADJUSTABLE REFLEX SIGHT

This application is a national phase of International Application No. PCT/SE2019/050865 filed Sep. 12, 2019, which claims priority to Swedish Application No. 1851079-2 filed Sep. 12, 2018, both of which are hereby incorporated herein by reference.

TECHNICAL FIELD

The present disclosure relates to an adjustable reflex sight, and more particularly to an adjustable reflex sight comprising a sight adjustment mechanism.

BACKGROUND

Reflex sights also known as red dot sights are popular sights both for civilian users such as hunters and sportsmen but also for professional users such as police and military to allow a user of a weapon to accurately aim at a selected target.

The reflex sight has a number of advantages over a traditional iron sight as well as a magnifying telescope sight. A user of the reflex sight may have both eyes open, i.e. one eye looking through the sight for aiming at a target and the other eye may look at the environment surrounding the target. Thereby, the user may focus on the target and fire faster than with traditional iron sights or optical magnifying telescope sights. Additionally, the reflex sight has an unlimited eye relief and the user of the reflex sight may not only find the target fast but also shoot with both eyes open.

Due to the advantageous features, reflex sights are commonly used with different kinds of firearms, for example shotguns, automatic and semi-automatic rifles, and small firearms, such as handguns etc.

When a reflex sight is mounted on a firearm, it is aligned to the weapon and a zero point for the sight is determined by adjusting the sight relative to the barrel of the firearm until the impact point of the bullet matches a target at a known distance.

A bullet fired from a firearm begins to fall when it leaves the barrel and continues to fall during the travel to the target due to the force of gravity. Moreover, the bullet may be influenced by different wind conditions, temperature, humidity etc.

Adjustment of elevation and windage are accomplished on magnifying rifle scopes by means of two laterally protruding adjustment knobs arranged on the sight.

Bullet ballistic trajectory, wind conditions, and distance to the target can vary depending upon different shooting conditions. Appropriate compensation means is required for allowing a shooter to make adjustments to the aiming of the sight relative to the weapon on which it is mounted. These adjustments are known as elevation and windage adjustments, and are typically accomplished by lateral movement of adjusting members located within the sight.

With reference to U.S. Pat. No. 6,691,447, an index mark on the housing of a riflescope provides a reference by which a shooter may read a scale marked around the circumference of the adjustment knob. The shooter typically adjusts windage and elevation so that a bullet will hit a target at a particular known reference distance, e.g., 100 m, when an aiming mark of the reticle is centered on the target viewed through the riflescope. When the shooter wants to shoot at a target at a different distance, e.g., 200 m, or under different wind conditions, the shooter rotates the holdover and windage adjustment knobs a known amount to accurately place the aiming mark for the target. Some scopes provide a mechanism for adjusting the angular position of the scale on the knob independently of the actual windage or holdover adjustment so that the shooter can align the zero mark of the scale with the index mark on the outer tube after the rifle has been sighted in at the reference distance. The shooter can then easily return to the sighted-in windage and holdover positions. However, a scale around the circumference of the adjustment knob only indicates rotation of less than 360° and does not provide the shooter with an indication of the number of rotations of the knob.

Further, U.S. Pat. No. 6,691,447 discloses an adjustment mechanism for sighting devices such as riflescopes and, in particular, a non-telescoping adjustment mechanism, including a scale that indicates the number of rotations of the adjustment mechanism. When the shooter adjusts for windage and holdover, a datum, such as the inwardly depending edge of the adjustment knob, moves along a scale, which may include a set of indicia positioned on the index slide and spaced apart along the axis. The direction of relative movement of the scale and the datum is along the axis of rotation. The scale and the datum cooperate so that their relative movement provides a visual indication of the amount of rotation of the core, such that the shooter can determine the number of turns through which the adjustment mechanism has been rotated.

US2014352487 discloses n adjustment device having a rotatable knob for changing an adjustable setting of an aiming device, such as a riflescope. The knob includes a removable indicator ring slidable onto the knob and bearing a scale to provide visual feedback to a shooter regarding an adjustment position of the adjustable setting. The knob further carries a releasable latch that may extend radially outward relative to the knob to retain the indicator ring on the knob when the latch is in the latched position. When the shooter desires to remove and replace the indicator ring, such as in response to a change in shooting conditions, the latch may be released to an unlatched position to allow the indicator ring to be moved off of the knob. The shooter may thereafter insert a replacement indicator ring on the knob.

US2014319216 discloses a riflescope aiming system that includes a telescopic sight, a multiple-zero-point elevation turret and an aiming reference system. The multiple-zero-point elevation turret includes a rotatable indicator carrier and a plurality of indicator pins secured to the indicator carrier, each indicator pin corresponding to a predetermined target distance. The aiming reference system is operably coupled to the objective housing of the telescopic sight and displays aiming reference data.

Some prior art adjustment systems of magnifying rifle scopes may compensate for ballistic trajectory, wind conditions, and distance to the target under various shooting conditions. However, adjustment to different distances and/or different ballistic conditions may require a number of turns of the adjustment knobs in one direction or the other, which may be cumbersome, inconvenient, timewasting, and may cause error adjustment. The adjustment range may even be insufficient for a large variation in distance or ballistic conditions. Additionally, the prior art adjustment systems are generally complex, cumbersome and expensive arrangements including a number of components.

Thus, the present inventor has recognized a need for an improved adjustment mechanism adapted to reflex sights.

SUMMARY

It is an object of the teachings of this application to obviate at least some of the disadvantages discussed above.

In accordance with one aspect of the present disclosure, this is achieved by a an adjustable reflex sight comprising:

an elongated sight housing comprising an outer tube and an inner tube pivotably mounted within the outer tube and holding an optical element for pivoting movement therewith, a sight adjustment mechanism mounted to the housing having an adjustable member movably mounted within the adjustment mechanism for altering a tilt angle of the inner tube in relation to the outer tube thereby adjusting the sight.

The sight adjustment mechanism comprises a first adjustment device interlinked with a second adjustment device, wherein the first adjustment device is adjustably positionable about an axis of rotation for actuating said adjustable member, thereby altering the tilt angle of the inner tube, and the second adjustment device is adjustably positionable about the axis of rotation, such that the interlinked first adjustment device and the adjustable member are moved along the axis of rotation in response to rotation of the second adjustment device.

In some embodiments, the first adjustment device is adjustably positionable about the axis of rotation with a first pitch ratio for actuating said adjustable member, thereby altering the tilt angle of the inner tube according to the first pitch ratio, and the second adjustment device is adjustably positionable about the axis of rotation with a second pitch ratio, such that the first adjustment device and the adjustable member are moved along the axis of rotation according to the second pitch ratio in response to rotation of the second adjustment device.

In some embodiments, the first pitch ratio and the second pitch ratio are different.

The first pitch ratio may advantageously be smaller than the second pitch ratio.

The first adjustment device may advantageously be a point of aim adjustment device for fine adjustment of the sight.

The second adjustment device may advantageously be a ballistic adjustment device arranged to be adjusted according to different ballistic conditions associated with different kinds of ammunition and/or different kinds of weapons.

The sight adjustment device may be provided horizontally on top of the sight for elevation adjustments and/or vertically on a side of the sight for windage adjustments.

Further embodiments are defined by the dependent claims.

In accordance with a second aspect of the present disclosure, a removable adjustment cap for adjusting a reflex sight having a sight adjustment mechanism comprising a first adjustment device interlinked with a second adjustment device is provided. The adjustment cap is provided with an aperture in a top surface of the cap for facilitating access to the first adjustment device, and an exterior gripping surface for rotation of the second adjustment device.

Advantageously, the removable adjustment cap comprises a scale including a set of indicia spaced apart and around a circumference of the top surface of the cap to facilitate adjustment for ballistic conditions.

An advantage of some embodiments is that the adjustable reflex sight provides point of aim adjustment for fine adjustment of the sight and ballistic adjustment to compensate for different ballistic conditions.

Advantageously, the adjustable reflex sight may be adjusted for distances up to several hundred meters according to some embodiments.

Other aspects and features of the invention and its embodiments are defined by the appended patent claims and are further explained, together with problems solved and advantages obtained, in the detailed description section as well as in the drawings.

It should be emphasized that the term "comprises/comprising" when used in this specification is taken to specify the presence of stated features, integers, steps, or components, but does not preclude the presence or addition of one or more other features, integers, steps, components, or groups thereof.

All terms used in the claims are to be interpreted according to their ordinary meaning in the technical field, unless explicitly defined otherwise herein. All references to "a/an/the element, device, component, means, etc are to be interpreted openly as referring to at least one instance of the element, device, component, means, etc., unless explicitly stated otherwise.

BRIEF DESCRIPTION OF THE DRAWINGS

Exemplary embodiments is illustrated by way of example in the accompanying drawings in which like reference numbers indicate the same or similar elements and in which.

DESCRIPTION OF EMBODIMENTS

Embodiments of the invention will be described with reference to FIGS. 1-6. In cooperation with attached drawings, the technical contents and detailed description of the present invention are described thereinafter according to a preferable embodiment, being not used to limit its executing scope. Any equivalent variation and modification made according to appended claims are covered by the claims.

Reference will now be made to the figures to describe the embodiments in detail. The same reference signs are used for corresponding features in different figures.

Figure 1:
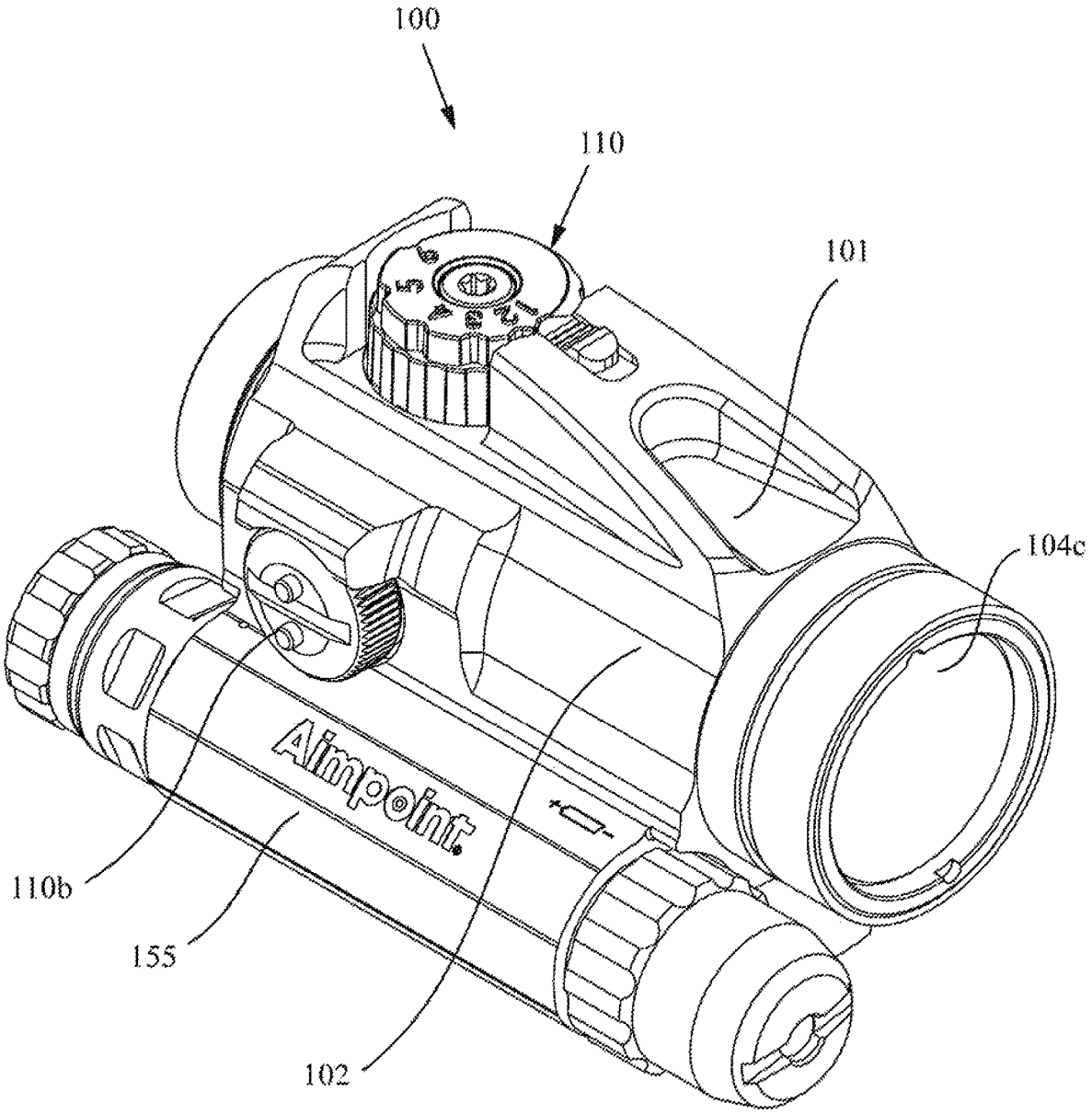
FIG. 1 is a perspective view of a reflex sight with a sight adjustment mechanism according to the invention.

Reference is made to FIG. 1, which is a perspective view of an exemplary embodiment of a reflex sight 100 providing elevation and/or windage adjustments. The reflex sight comprises at least one adjustment mechanism 110, 110*b* providing compensation for variation in one or more different shooting conditions, including, but not limited to one or more of: distance to the target, bullet or projectile trajectory, kind of weapon, barrel, windage, humidity, temperature etc.

The reflex sight 100 is adapted to be firmly attached to a firearm, including but not limited to a rifle, shotgun, automatic and semi-automatic rifles, and small firearms, such as handguns by means of a mount (not shown) or bracket. The reflex sight 100 comprises an elongated sight housing 101 comprising an outer tube 102, an inner tube 103 and at least an optical element or lens. In this embodiment the reflex sight is a red dot sight including a battery socket 155 for voltage feed of the source of light generating the red dot.

Figure 2:
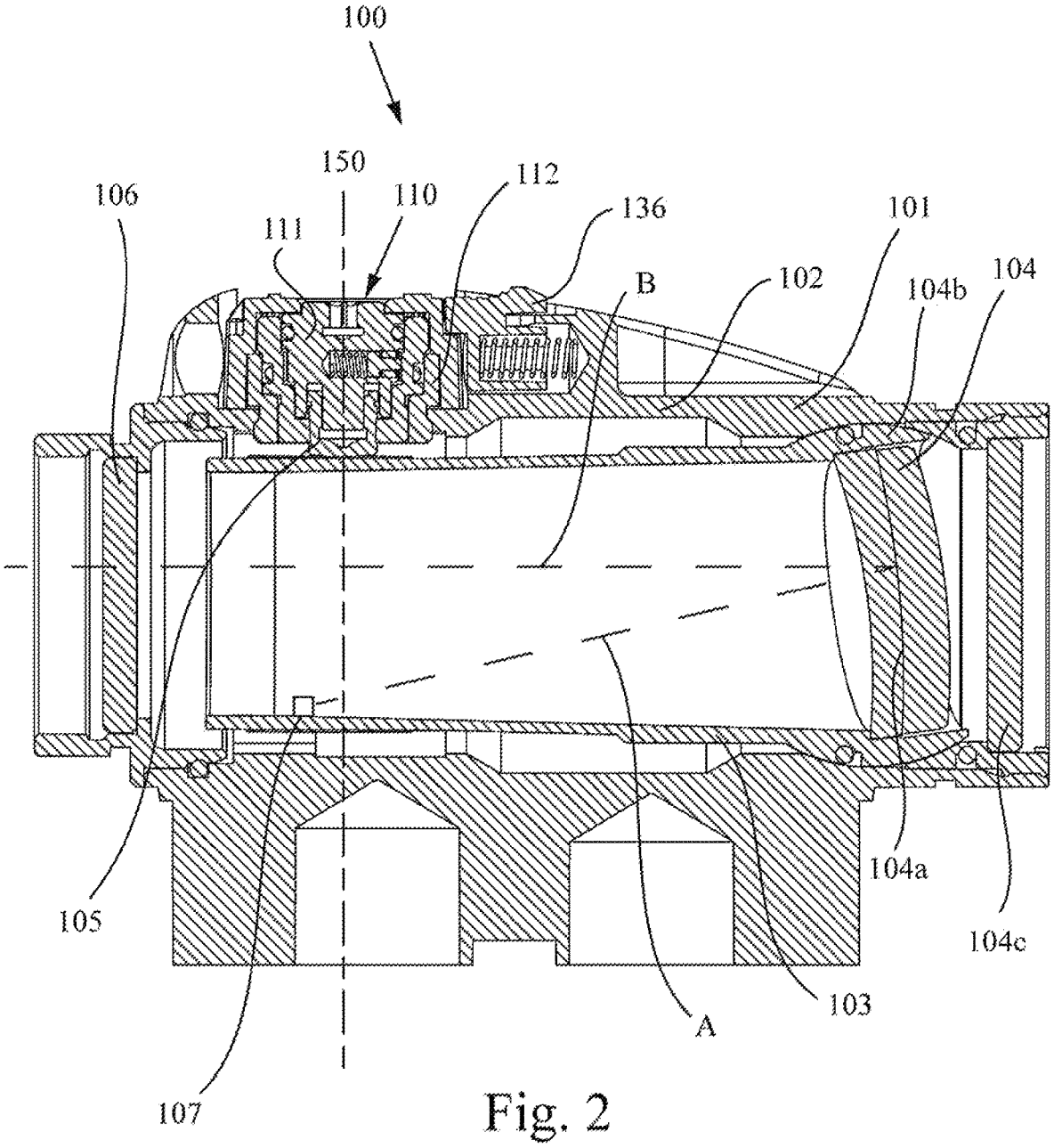
FIG. 2 is a schematic cross sectional view along a longitudinal axis of the reflex sight in FIG. 1.

FIG. 2 is a cross sectional view along a longitudinal axis of the reflex sight in FIG. 1, illustrating different components of an exemplary embodiment. In this embodiment, the reflex sight 100 comprises the longitudinal inner tube 103 having an essentially circular cross-section, wherein the inner tube 103 is pivotally secured within the front end of the outer tube 102. The lens 104 may be, but is not limited to, a circular lens or lens arrangement with an inner partially reflective surface 104*a*. The lens is arranged in a support section 104*b* in a front end of the inner tube 103 intended to face a target (not shown). A front glass 104*c* may be arranged in the front end of the outer tube 102 for protecting the lens from dirt, moisture, snow, fingerprints etc and from being scratched. A viewing glass plate 106 is supported at the rear end of the sight housing 101 facing an eye of a shooter.

A battery powered light source 107 is arranged in a light channel inside the inner tube 103 to project a beam of light through a path, indicated by a dashed line A, angled in a direction to the reflective surface 104*a* of the lens 104. The light beam is reflected by the reflective surface 104*a* along an optical axis of the light channel, indicated by a dashed line B, through the glass plate 106 to the shooter (not shown). Thereby, the inner tube 103 forms a light channel. Hence, when the shooter looks at the target through the light channel from this rear end, the shooter sees a dot as a reticle, which may be put on the spot on the target for the desired point of impact.

The light source 107 may be, but is not limited to, a Light Emitting Diode, LED, having a diameter of 20-80 μm. The reflective surface 104*a* of the lens 104 may be a Mangin mirror. In such an arrangement the Mangin mirror may be evaporated on a conventional lens. Further, the light source may be configured to emit light to provide a reticle in other shapes, such as an illuminated cross hair or any other suitable shape.

The inner tube 103 is movably biased by the at least one adjustment mechanism 110 at the rear end of the sight housing 101. The adjustment mechanism 110 comprises a first adjustment device 111, which is interlinked with a second adjustment device 112, thereby allowing adjustment of the longitudinal axis of the inner tube 103 in a vertical direction in relation to the longitudinal axis of the sight housing 101 in order to calibrate the sight to a particular firearm. This procedure is also known as zeroing.

The first adjustment device 111 may be a point of aim adjustment device for fine adjustment of the sight, while the second adjustment device 112 may be a ballistic adjustment device arranged to be adjusted according to different ballistic conditions associated with, but not limited to, different kinds of ammunition and/or different kinds of weapons, exit velocity of the bullet, different temperatures, humidity etc.

The corresponding horizontal adjustment mechanism 110*b* as shown in FIG. 1, may also be provided, making the inner tube 103 movably biased allowing adjustment of the longitudinal axis of the inner tube 103 in a horizontal direction in relation to the longitudinal axis of the sight housing 101. The respective sight adjustment mechanism 110, 110*b* has an adjustable member 105 movably mounted within the adjustment mechanism 110,110*b* for altering a tilt angle of the inner tube 103 in relation to the outer tube 102 thereby adjusting the sight 100. Hence, the reflex sight 100 may be calibrated relative to the trajectory of the bullet to compensate for elevation and/or windage.

When the reflex sight 100 is mounted on a firearm, the user then may view the target or object in the scene through the viewing glass plate 106, the light channel through the inner tube 103, the lens 104 and the protecting front glass plate 104*c*. In order to assist in aiming, the red dot emitted from the light source 107 is projected onto the reflective surface 104*a* of the lens 104 and is reflected back to the eye of the shooter through the glass plate 106. Hence, the inner tube 103 is selectively movable relative to the outer tube 102 by means of the adjustment mechanisms 110, 110*b*. Thereby, the elevation and horizontal adjustment mechanisms 110 and 110*b* are arranged to adjust the reflex sight 100 relative to the trajectory of the bullet to compensate for elevation and/or windage and/or other variation in different shooting conditions.

In this embodiment the sight adjustment mechanism 110 is mounted to the housing 101. Further, the adjustable member 105 is movably mounted within the adjustment mechanism 110. As mentioned above, the first adjustment device 111 is interlinked with a second adjustment device 112. The first adjustment device 111 is adjustably positionable about an axis of rotation 150 for actuating the adjustable member 105 in response to user rotating the first adjustment device. Thereby the tilt angle of the inner tube 103 may be altered. Similarly, the second adjustment device 112 is adjustably positionable about the axis of rotation 150, such that the interlinked first adjustment device 111 and the adjustable member 105 may be moved along the axis of rotation 150 in response to rotation of the second adjustment device.

In this embodiment the first adjustment device 111 is adjustably positionable about the axis of rotation 150 with a first pitch ratio for actuating the adjustable member 105, thereby altering the tilt angle of the inner tube 103 according to the first pitch ratio. The second adjustment device 112 is adjustably positionable about the axis of rotation 150 with a second pitch ratio, such that the first adjustment device 111 and the adjustable member 105 may be moved along the axis of rotation 150 according to the second pitch in response to rotation of the second adjustment device 112.

The first pitch ratio and the second pitch ratio may be different. According to this embodiment of the adjustment mechanism, the first pitch ratio is smaller than the second pitch ratio. The first pitch ratio may be, but is not limited to, 0.1-0.3 mm/turn, and the second pitch ratio may be, but is not limited to 0.3-0.6 mm/turn. Thereby the first adjustment device 111 is adapted to be a point of aim adjustment device for fine tuning of the sight and the second adjustment device 112 may be a ballistic adjustment device arranged to be adjusted according to different ballistic conditions associated with different kinds of ammunition and/or different kinds of weapons.

Figure 3:
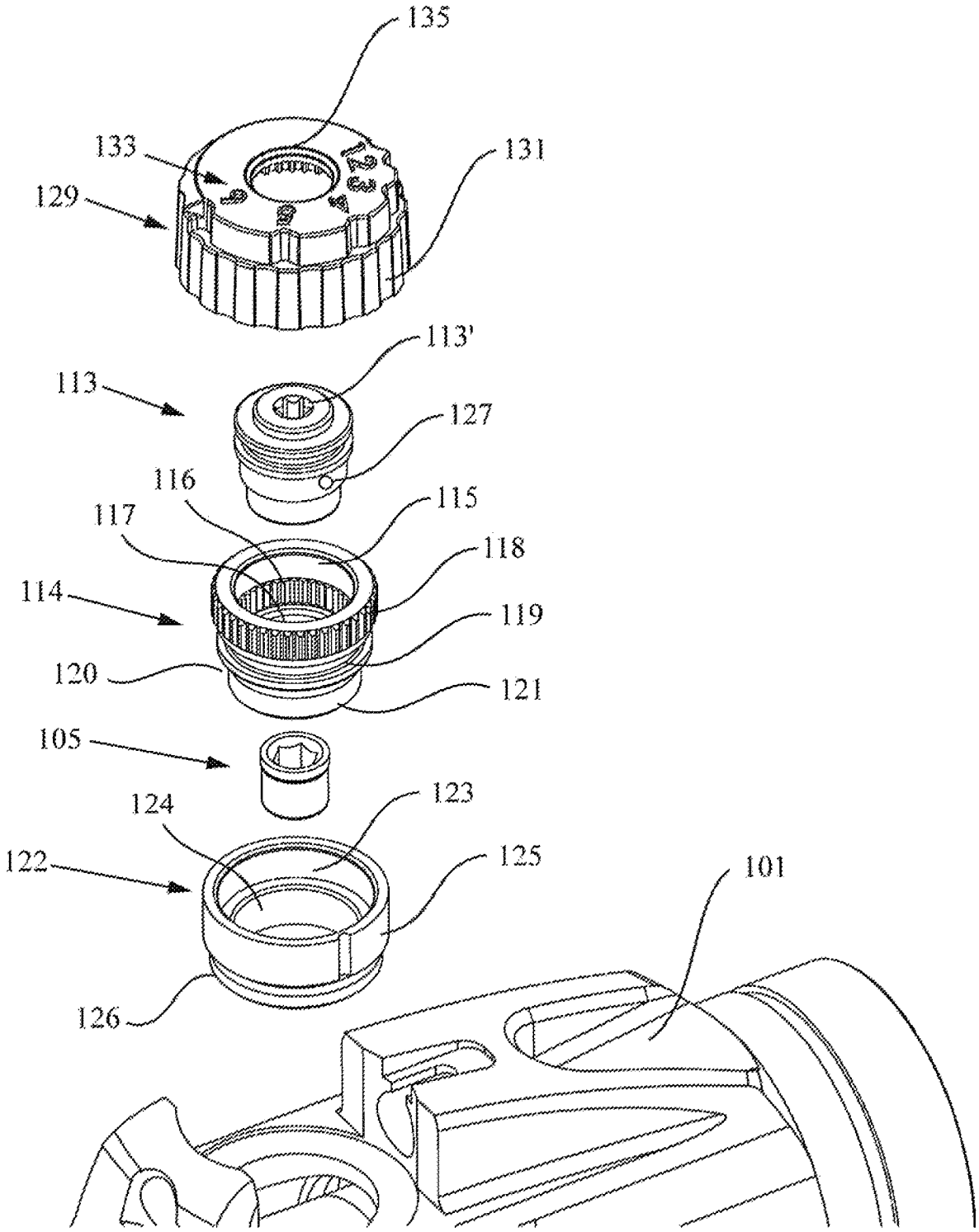
FIG. 3 is a perspective explode view showing components of an embodiment of the adjustment mechanism on top of the reflex sight.
Figure 4:
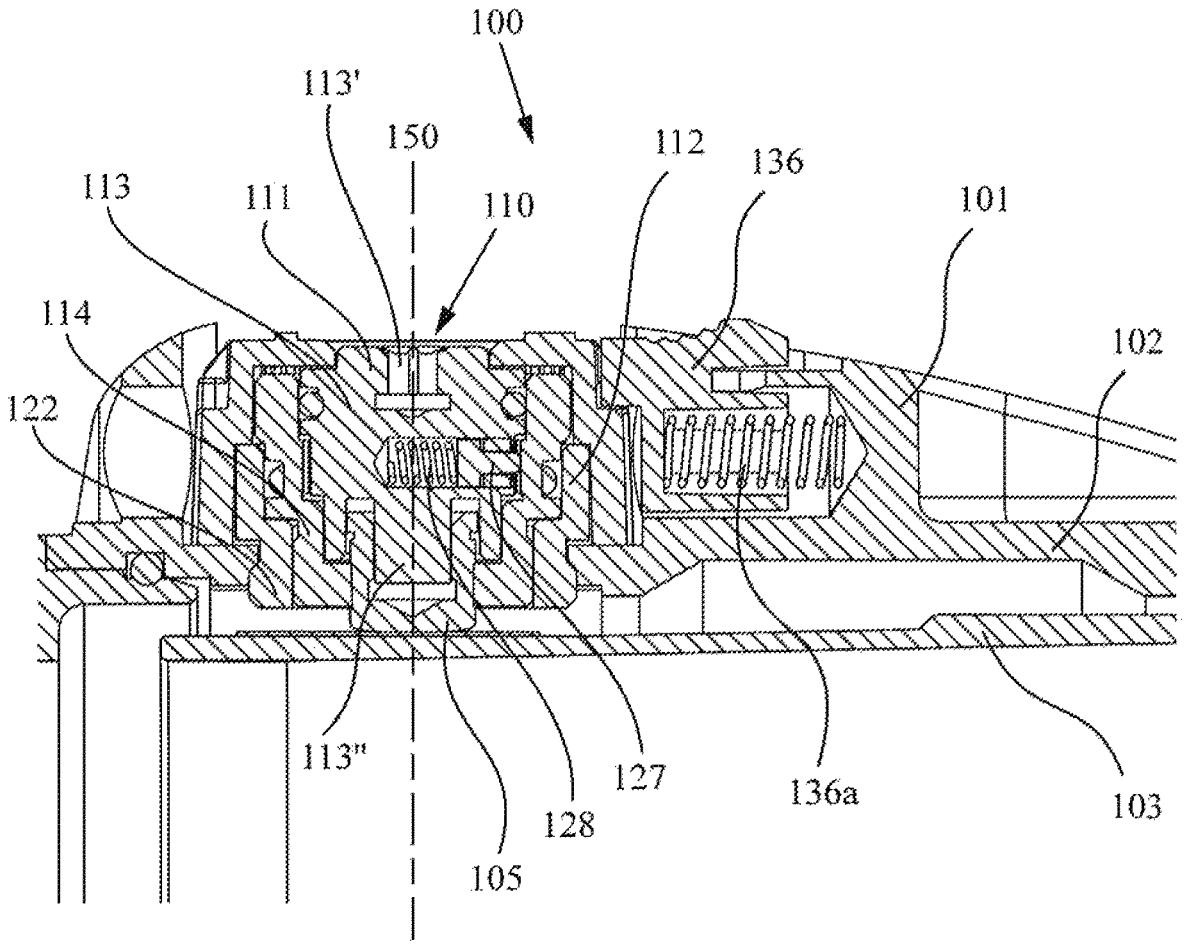
FIG. 4 is an enlarged schematic cross-sectional view of the adjustment mechanism of FIG. 1.

Components of an embodiment of the adjustment mechanism 110 to be arranged on top of the reflex sight 100 are illustrated in an exploded perspective view in FIG. 3. The first adjustment device comprises a rotating knob 113 with a first end 113' in a shape of hexalobular socket and a second end 113" in a shape of a hexalobular screwdriver bit. In other embodiments, the first end 113' may be in a shape of, but not limited to, a slotted or polygone socket and the second end 113" may be in a shape of, but is not limited to, a polygone screwdriver bit. Further, a pin 127 may be arranged in a bore of the knob 113 and protruding radially, i.e perpendicular to the axis of rotation 150, outwardly from a middle portion of a cylindrical envelope surface of the knob by means of a biasing element, such as a biasing spring 128 as shown in FIG. 4.

With further reference to FIG. 3, the first adjustment device may include a polygone socket, such as hex socket, screw with a thread of the first pitch forming the adjustable member 105, which may be slidably arranged on the second end 113" of the knob 113 when the component of the adjustment mechanism are assembled.

Further, the first adjustment device 111 comprises an adjustment nut 114 with an interior surface and an exterior surface. The interior surface may be provided with an upper flat portion 115, a middle toothed portion 116, and a lower threaded portion 117 with the first pitch. The exterior surface may be provided with an upper toothed portion 118, a middle flat portion 119 with a lip 120 extending around the exterior surface, and a lower threaded portion 121 with the second pitch.

The second adjustment device 112 comprises a cylindrical retention flange 122 with an interior surface and an exterior surface as illustrated in FIG. 3. The interior surface may be provided with an upper flat portion 123, and a lower threaded portion 124 with the second pitch. The exterior surface may be provided with an upper flat portion 125, and a lower threaded portion 126 to secure the second adjustment device 112 to the sight.

The adjustment mechanism 110, 110*b* further includes a removable adjustment cap 129 for adjusting the reflex sight 100, wherein the adjustment cap 129 is provided with an aperture 135 in a top surface of the cap for facilitating access to the first adjustment device 111, and an exterior gripping surface 131 for rotation of the second adjustment device.

Figure 5A:
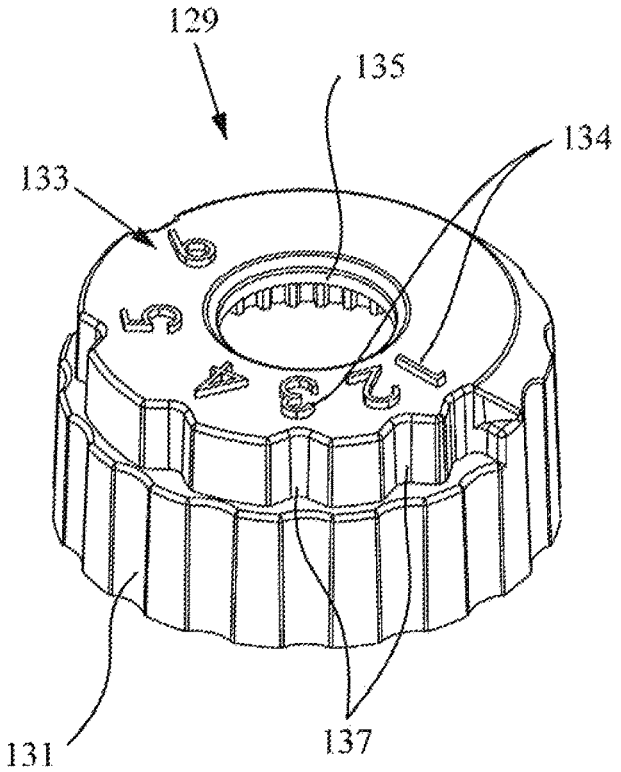
FIG. 5A is an enlarged perspective top view of a removable cap of the adjustment mechanism of FIG. 1.

As illustrated in further detail in FIG. 5A, the removable adjustment cap 129 is provided with a scale 133 including a set of indicia 134 spaced apart and around a circumference of the top surface of the cap to facilitate adjustment for ballistic conditions. The scale 133 of each removable cap 129 may have a different set of indicia spaced apart with different distance, thereby adapted for adjustment for various ballistic conditions associated with different weapons and/or various ammunitions in response to rotation of the cap.

Figure 5B:
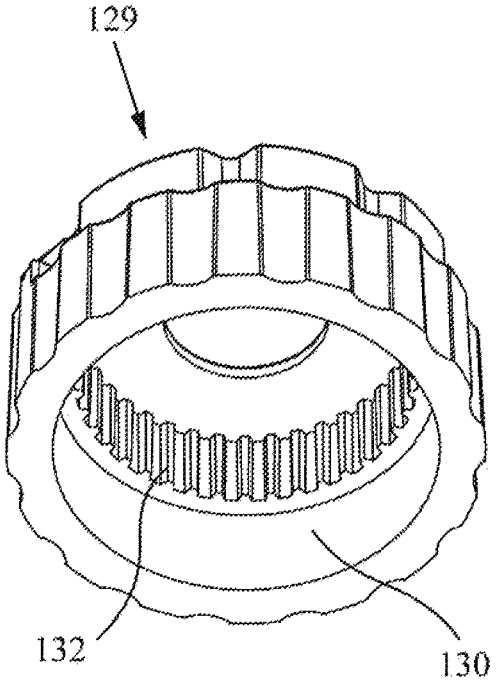
FIG. 5B is an enlarged perspective bottom view of the removable cap of FIG. 5B.

Referring to FIG. 5B, the removable adjustment cap 129 is provided with an interior contact surface 130 including a toothed portion 132 adapted to engage with grooves of the upper toothed portion 118 of the exterior surface of the adjustment nut 114 for facilitating rotation of the nut.

Figure 6:
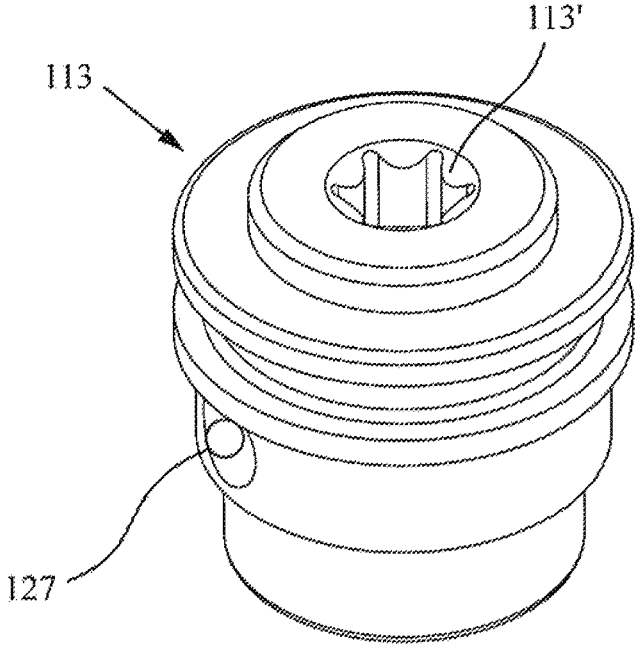
FIG. 6 is an enlarged perspective view of a rotating knob of the adjustment mechanism of FIG. 1.

FIG. 6 is an enlarged perspective view of the rotating knob 113 illustrating the first end 113' in a shape of hexalobular socket and the protruding pin 127.

The assembly of the separate components shown in FIG. 3 is shown in FIG. 4. In this embodiment, the sight adjustment device 110 may be arranged horizontally on top of the reflex sight 100 as illustrated in FIG. 4 for elevation adjustments.

The knob 113 may be rotatably arranged in the adjustment nut 114 by means of the pin 127 arranged in the bore of the knob 113 and protruding radially outwardly from the knob by means of the biasing element 128. The pin 127 may reside in a one of a number of grooves in the middle toothed portion 116 of the interior surface of the adjustment nut 114, thereby providing a tactile click and an incremental rotational movement of the knob 113, in response to rotation of the knob 113. The knob 113 may preferably be rotated by accessing the hexalobular socket in the first end 113' by means of a tool through the aperture 135 of the removable adjustment cap 129. In response to rotation of the knob 113, the adjustable member 105 is moved along the axis of rotation in the lower threaded portion of the adjustment nut 114 according to the first pitch ratio. However, the adjustment nut 114 is not rotated in response to the rotation of the knob 113. Thereby, the reflex sight may only be incrementally adjusted according to the first pitch ratio to adjust the sight for elevation or windage, i.e fine adjustment of the sight.

The first adjustment device 111 may be interlinked with the second adjustment device 122 by screwing the adjustment nut 114 into the retention flange 122 by means of the lower threaded portion 121 of the adjustment nut 114 and the corresponding lower threaded portion 124 of the retention flange 122.

The adjustment mechanism is secured to the sight by means of the lower threaded portion 126.

Additionally, the adjustment mechanism 110 may comprise a latch 136 including a biasing element, such as a spring 136*a*, arranged on the sight housing 101. The biasing element exerts a force on the latch 136 to extend radially in to grooves 137 in the exterior surface of the adjustment cap 129 to retain the adjustment cap in fixed rotation positions and providing a tactile click. The rotation positions of the cap 129 correspond to incremental adjustment to various ballistic conditions indicated by said set of indicia. In response to a rotation of the adjustment cap 129 form one fixed rotation position to another fixed rotation position indicated on the scale, the adjustment nut 114 will be rotated a corresponding amount about the axis of rotation 150 with the first pitch ratio for actuating the adjustable member 105. However, the adjustment knob 113 will not be rotated, i.e the fine tuning will not be changed in response to the ballistic adjustment.

The overall sight assembly is advantageously resistant to recoil and shock, and prevents dirt, moisture etc to leak into the interior of the reflex sight 100.

Embodiments of the present invention have been described herein with reference to a reflex sight 100, which comprises a sight housing forming a longitudinal outer tube having an essentially circular cross-section and a longitudinal inner tube having an essentially circular cross-section, which is pivotally secured within the front end of the outer tube. It will be understood that the sight housing, outer tube and the inner tube may have other shapes than an essentially circular cross-section in other embodiments, for example, square-shaped, triangular, rectangular, pentagonal, hexagonal, etc without departing from the scope of the claims.

The invention is not limited to that the inner tube is pivotally secured within the front end of the outer tube. In other embodiments, the inner tube may be pivotally secured to the back end of the outer tube, without departing from the claimed invention.

The features and advantages of the invention are apparent from the detailed specification, and thus it is intended by the appended claims to cover all such features and advantages of the invention, which fall within the scope of the technology. For example, the light source may be a Light Emitting Diode, LED, or a resonant cavity light emitting diode, RCLED, generating red light. However, other light sources generating red light or any other suitable colour, for example, green, blue, yellow, may be used.

Other configurations are possible within the scope of the present patent claims. However, although embodiments of the reflex sight 100 has been illustrated in the accompanying drawings and described in the foregoing detailed description, the disclosure is illustrative only, and changes, modifications and substitutions may be made without departing from the scope of the technology as set forth and defined by the following claims. Hence, it should be understood that the limitations of the described embodiments are merely for illustrative purpose and by no means limiting. Instead, the scope of the technology is defined by the appended claims rather than by the description, and all variations that fall within the range of the claims are intended to be embraced therein.

In addition, singular references do not exclude a plurality. The terms "a", "an", "first", "second" etc do not preclude a plurality. Reference signs in the claims are provided merely as a clarifying example and shall not be construed as limiting the scope of the claims in any way.

The invention claimed is:

1. An adjustable reflex sight comprising:

an elongated sight housing comprising an outer tube and an inner tube pivotably mounted within the outer tube and holding an optical element for pivoting movement therewith, a sight adjustment mechanism mounted to the housing having an adjustable member movably mounted within the adjustment mechanism for altering a tilt angle of the inner tube in relation to the outer tube thereby adjusting the sight, wherein the sight adjustment mechanism comprises a first adjustment device, which is a point of aim adjustment device for fine adjustment of the sight, interlinked with a second adjustment device, which is a ballistic adjustment device arranged to be adjusted according to different ballistic conditions, wherein the first adjustment device is adjustably positionable about an axis of rotation for actuating said adjustable member, thereby altering the tilt angle of the inner tube, and the second adjustment device is adjustably positionable about the axis of rotation, such that the interlinked first adjustment device and the adjustable member are moved along the axis of rotation in response to rotation of the second adjustment device.

2. The reflex sight of claim 1, wherein the first adjustment device is adjustably positionable about the axis of rotation with a first pitch ratio for actuating said adjustable member, thereby altering the tilt angle of the inner tube according to the first pitch ratio, and the second adjustment device is adjustably positionable about the axis of rotation with a second pitch ratio, such that the first adjustment device and the adjustable member are moved along the axis of rotation according to the second pitch ratio in response to rotation of the second adjustment device.

3. The reflex sight of claim 2, wherein the first pitch ratio and the second pitch ratios are different.

4. The reflex sight of claim 3, wherein the first pitch ratio is smaller than the second pitch ratio.

5. The reflex sight of claim 2, wherein the first adjustment device comprises a rotating knob, said knob has a first end in a shape of a slotted, polygone, or hexalobular socket and a second end in a shape of a polygone, such as a hexalobular, screwdriver bit, and a polygone socket, such as hex socket, screw with a thread of the first pitch forming said adjustable member, which is slidably arranged on the second end of the knob.

6. The reflex sight of claim 2, wherein the first adjustment device comprises an adjustment nut with an interior surface and an exterior surface, wherein the interior surface has an upper flat portion, a middle toothed portion, and a lower threaded portion with the first pitch, and the exterior surface has an upper toothed portion, a middle flat portion with a lip extending around the exterior surface, and a lower threaded portion with the second pitch.

7. The reflex sight of claim 6, wherein the second adjustment device comprises a cylindrical retention flange with an interior surface and an exterior surface, wherein the interior surface has an upper flat portion and a lower threaded portion with the second pitch, and the exterior surface has an upper flat portion, and a lower threaded portion to secure the second adjustment device to the sight.

8. The reflex sight of claim 6, wherein said knob is rotatably arranged in the adjustment nut of said first adjustment device by means of a pin arranged in a bore of the knob and protruding radially outwardly from the knob by means of a biasing elements, wherein said pin reside in a one of a number of grooves in the middle toothed portion of the interior surface of the adjustment nut, thereby providing a tactile click, in response to rotation of the knob for moving the adjustable member along the axis of rotation in the lower threaded portion of the adjustment nut.

9. The reflex sight of claim 6, wherein the adjustment device comprises a removable adjustment cap with an interior contact surface and an exterior gripping surface, wherein the interior contact surface includes a toothed portion adapted to engage with grooves of the upper toothed portion of the exterior surface of the adjustment nut for facilitating rotation of the nut.

10. The reflex sight of claim 9, wherein the adjustment cap including a set of indicia spaced apart and around a circumference of a top surface of the cap to facilitate adjustment for ballistic conditions.

11. The reflex sight of claim 10, wherein the scale of each removable cap is adapted for adjustment for various ballistic conditions associated with different weapons and/or various ammunitions in response to rotation of the cap.

12. The reflex sight of claim 11, wherein the adjustment cap is provided with a central aperture in a top surface for facilitate access to the first adjustment device.

13. The reflex sight of claim 10, comprising a latch arranged on the sight housing configured to retain the adjustment cap in fixed rotation positions, each corresponding to various ballistic conditions indicated by said set of indicia.

14. The reflex sight of claim 2, wherein the first pitch ratio is 0.1-0.3 mm/turn and the second pitch ratio is 0.3-0.6 mm/turn.

15. The reflex sight of claim 1, wherein the second adjustment device is a ballistic adjustment device arranged to be adjusted according to different ballistic conditions associated with different kinds of ammunition and/or different kinds of weapons.

16. The reflex sight of claim 1, wherein the sight adjustment device is provided horizontally on top of the sight for elevation adjustments.

17. The reflex sight of claim 1, wherein the sight adjustment device is provided vertically on a side of the sight for windage adjustments.

18. The reflex sight of claim 1, comprising a light source arranged in a light channel inside the inner tube and adapted to project a beam of light through a path (A), angled in a direction to a reflective surface of the optical element for providing a reticle.

* * * * *